United States Patent [19]

Irving, Jr. et al.

[11] 3,972,255

[45] Aug. 3, 1976

[54] BAKERY PRODUCT SLICER

[75] Inventors: Frank M. Irving, Jr., York; Albert S. Schmidt, Sr., Wormleysburg, both of Pa.

[73] Assignee: Alto Corporatation, York, Pa.

[22] Filed: Sept. 15, 1975

[21] Appl. No.: 613,260

[52] U.S. Cl. ..... 83/4; 83/11; 83/9

[51] Int. Cl.[2] ..... B26D 1/28; B26D 3/08

[58] Field of Search ..... 83/1, 4, 9, 11

[56] References Cited

UNITED STATES PATENTS

| | | | |
|---|---|---|---|
| 1,491,438 | 4/1924 | Theobald | 83/4 |
| 2,987,089 | 6/1961 | Lecrone | 83/4 |
| 3,911,769 | 10/1975 | Lecrone | 83/4 |

*Primary Examiner*—Willie G. Abercrombie

*Attorney, Agent, or Firm*—Thomas Hooker

[57] ABSTRACT

A bakery product slicer for forming vertical slits extending along proof lines between adjacent buns in clusters of buns. The slicer includes a pendent support hanging over the path of movement of the cluster and having at its lower end an upstream-facing orienting portion and a trailing cutting blade. The blade is closer to the support surface than the orienting portion so that the orienting portion falls into the crease above the proof line and guides the blade along the proof line.

9 Claims, 6 Drawing Figures

12
14
84
38
40
2
76
90
88
36
20
22
80
18
10
26
28
16
78

BAKERY PRODUCT SLICER

The invention relates to a bakery product slicer for forming vertical slits extending along irregular proof lines in bakery product clusters, particularly clusters of hot dog buns.

Hot dog buns are baked in clusters or groups of individual buns secured together at irregular proof lines between adjacent buns. Each cluster is formed from a number of portions of dough which are placed on a pan and proofed so that they rise and contact each other at an irregular surface extending between the buns. The plane of contact is called the proof line. Following baking, the adjacent buns in the cluster are held together at the proof lines. The buns are most easily broken apart along the proof lines.

Following baking, the clusters of buns are sliced to form a horizontal slit in each bun for use in holding hot dogs. While horizontal slits are easily formed in the end buns of a cluster, formation of horizontal slits in the middle buns of a cluster has presented difficulties to the industry.

The horizontal slits in hot dog buns are conventionally formed by using rotary cutters supported by vertical shafts extending from the cutter blades upwardly to a support structure above the cluster. The vertical shafts are fixed on the slicer in alignment with the nominal location of the proof lines between the buns so that if a cluster of buns having a perfectly located vertical planar proof line were moved past the cutter, the axis of the cutter would move along the plane of the proof line. In order to prevent tearing of the buns it is necessary to pre-cut a vertical slit in the buns extending from the top of the buns to or slightly below the plane of the horizontal cutter. The vertical slit in the buns provides an opening along which the vertical shaft carrying the horizontal blade may travel without tearing the buns.

A number of slicers for forming vertical slits in bun clusters have been proposed. U.S. Pat. No. 2,811,997 discloses the use of a fixed vertically oriented rotary slicer for forming a vertical slice between interior rolls of a hot dog cluster to provide a path for the vertically extending shaft of the horizontal slicer. Other types of fixed vertical slicers using static or driven blades have been proposed. In each case, the slicer forms a slit extending along the nominal location of the proof line, resulting in the formation of a slice which does not follow the proof line, but rather slices off portions of the hot dog bun located between the actual proof line and the location of the nominal or perfect proof line. The result is an unsightly product having reduced customer appeal. Further, because the joint at the proof line is weak, the bun slivers between the proof line and the slit formed by conventional vertical slicers tend to break away from the bun at the proof line and wrap around the shafts of the horizontal slicers, resulting in injury to the subsequent buns moving through the slicer.

The improved vertical slicer of the present invention includes a hanging or pendent blade holder freely supported on the frame of the slicer above the surface along which the clusters are moved. The lower end of the holder includes an orienting portion extending upstream and a slicing blade extending downstream. The blade holder is positioned in alignment with the nominal location of the proof line so that as a cluster is moved downstream toward the slicer, the orienting portion of the slicer falls into the crease between the buns above the proof line and the blade is guided along the proof line and cuts a vertical slit along the proof line. The cutter is free to swing laterally and twist about the support to permit the orienting portion to follow variations in the crease, thus assuring that the vertical slit follows the proof line. Because the slicer is supported on the frame an appreciable distance above the support surface, the slit is essentially vertical, despite lateral swinging of the slicer.

A conventional horizontal slicer is located downstream from the vertical slicer in alignment with the nominal proof line. The shaft of the slicer follows in the vertical slits formed immediately upstream by the vertical slicer. The portions of the hot dog buns above the horizontal slicer are resilient and are pushed aside by the vertical shaft when the vertical slit does not exactly align with the shaft.

The clusters are moved past the slicer by drive belts which engage the tops of the rolls to either side of the vertical and horizontal slicers. The belts diverge as they move downstream to hold the tops of the rolls apart and open the creases for the vertical slicers.

Other objects and features of the invention will become apparent as the description proceeds, especially when taken in conjunction with the accompanying drawings illustrating the invention, of which there are two sheets.

IN THE DRAWINGS

FIG. 6 is a sectional view of a cluster of hot dog buns after slicing.

Figure 1:
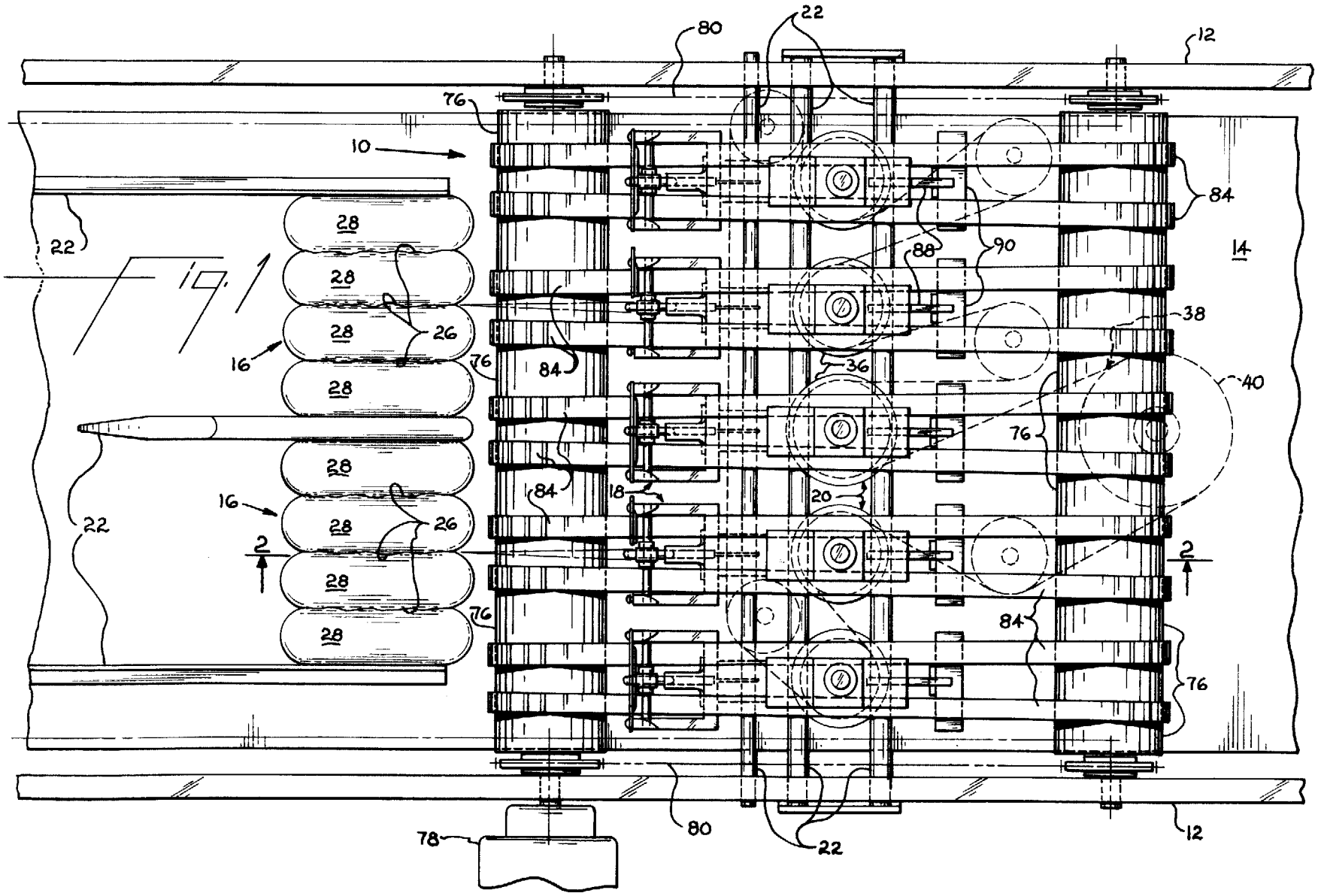
FIG. 1 is a top view, partially broken away, of a slicer according to the invention.

Hot dog bun slicer 10 is mounted on side rails 12 above product support surface 14 to engage and slice clusters 16 of hot dog buns as they are moved along the surface 12, from the left to the right as viewed in FIG. 1, and beneath the slicer. The slicer includes a number of vertical slicers 18 and a number of horizontal slicers 20. The slicers are adjustably mounted on support rods 22 extending between rails 12 to permit lateral adjustment depending upon the dimensions of the clusters. Guides 22 on surface 14 upstream of the slicer orient the clusters so that the proof lines 26 between adjacent buns 28 are nominally located directly upstream of the slicers. As illustrated in FIG. 1, the proof lines 26 extend irregularly along the length of the cluster.

The vertical and horizontal slicers 18 and 20 are arranged in pairs across the width of the slicer 10 with each vertical slicer located upstream of its paired horizontal slicer. The horizontal slicers 20 each include a block 30 mounted on rods 22. A vertical rotatable shaft 32 is journaled in each block 30 and carries a horizontal slicing blade 34 at the lower end thereof positioned slightly above surface 14. A drive pulley 36 is secured to the top of shaft 32 above block 30. The shafts and horizontal slicing blades of the slicing units 20 are rotated by a belt drive 38 illustrated in FIG. 1. Suitable idlers are provided for drive 38 and are adjusted as required to permit lateral shifting of the slicing units on rods 22. A motor (not illustrated) drives pulley 40 to rotate the slicing blades 34.

Each vertical slicer includes a support 42 bolted or otherwise secured to the upstream side of block 30. The support includes a pair of laterally spaced arms 44 each having an upstream extending portion 46 and a vertical portion 48 extending upwardly or away from surface 14 at the upstream end of portion 46. A shaft 50 is supported by vertical portions 48 of each member 42 and carries a pair of collars 52 spaced to either side of pendent holder 56. The shaft 50 extends through oversized hole 54 in pendent holder 56 and collars 52 are spaced apart a distance greater than the thickness of holder 56 so that the holder is free to twist and swing laterally on shaft 50 as indicated by lines 57 in FIG. 3 and lines 58 in FIG. 4.

Figures 2, 3, 4, 5:
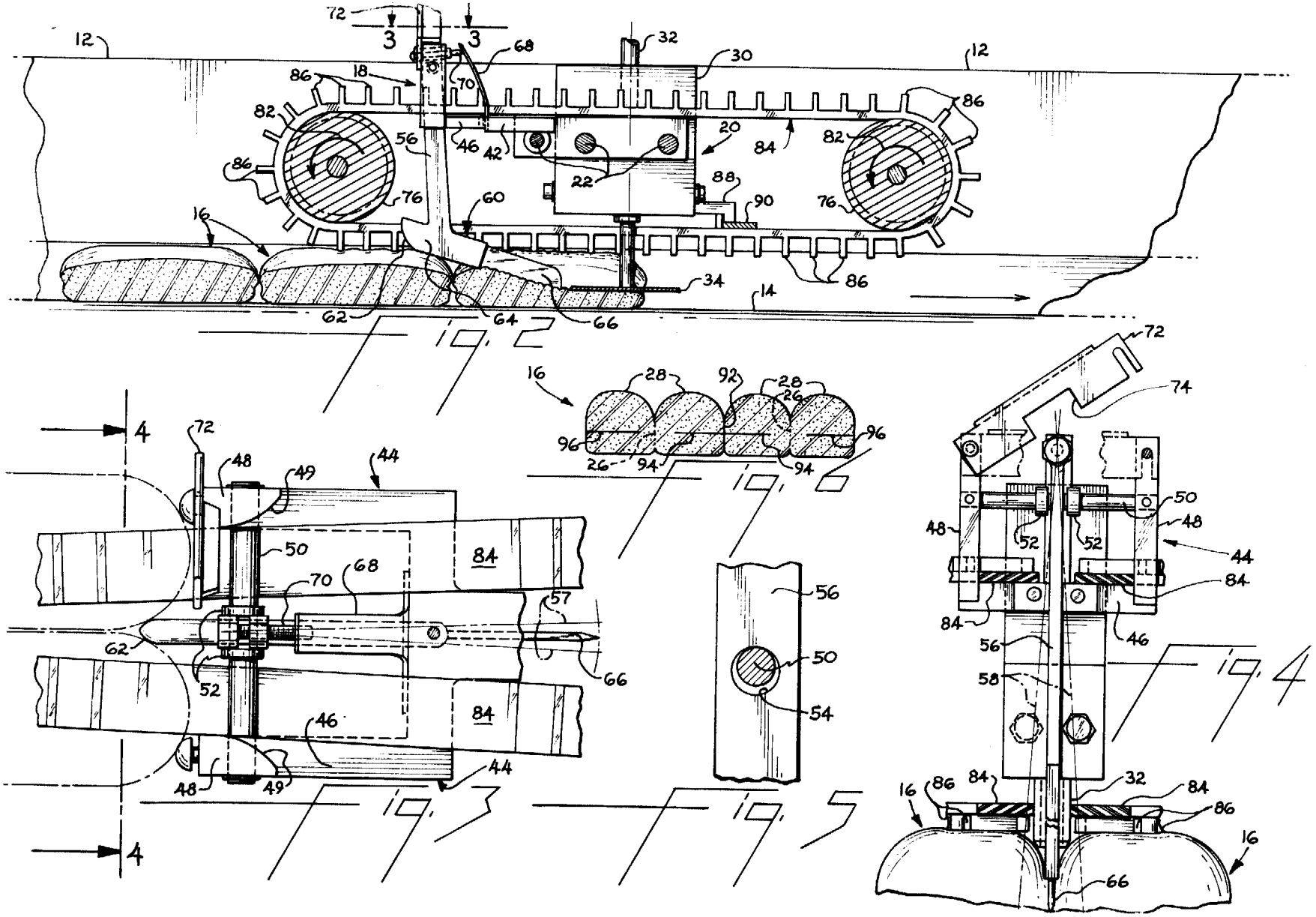
FIG. 2 is a view taken along line 2—2 of FIG. 1.
FIG. 3 is an enlarged view taken along line 3—3 of FIG. 2.
FIG. 4 is a sectional view taken along line 4—4 of FIG. 3.
FIG. 5 is a sectional view taken along line 5—5 of FIG. 4.

Slicing head 60 at the lower end of holder 56 is located a distance above surface 14 so that it tracks along the crease above the proof line between adjacent rolls as a cluster of rolls is moved past the slicer. The head includes a rounded nose 62 at the upstream end thereof and a thin orienting portion which extends downstream from the nose. The orienting portion 64 slopes toward the support surface 14 as illustrated in FIG. 2. A thin slicing blade 66 extends rearwardly and downwardly from the downstream end of the orienting portion to slice the buns. During slicing, the end of the blade is located slightly upstream from horizontal slicing blade 34 and slightly below the plane of the blade 34.

The free end of leaf spring 68 carried by support 42 engages adjustable stop bolt 70 extending through the upper end of blade holder 56 to resist downstream rotation of the slicing head and blade. The connection between the leaf spring and the bolt does not restrict twisting or swinging of the holder on shaft 50.

In some cases, it is desirable to run the slicer 10 with one or more vertical slicers in a retracted position so that the vertical slicing blades 66 do not engage buns passing under the slicer. To retract the vertical slicer a gate 72 is secured to the vertical portion of one arm 44 and includes a locking recess such that when the holder is rotated in a counter clockwise direction from the position shown in FIG. 2, and the gate is moved to a horizontal position and secured to the other arm 44, the recess 74 extends around the shank of stop bolt 70 and holds the slicer in a retracted position with blade 66 above surface 14 a distance greater than the height of the clusters passing beneath the slicer.

The horizontal and vertical slicers are located between a pair of cylindrical rolls 76 each extending laterally across the support surface 14. The rolls 76 are carried on shafts journaled in bearings on the support rails 12. A suitable drive, such a motor 78 and chains 80 running between sprockets on the support shafts, rotates the rolls in the direction of arrows 82 illustrated in FIG. 2. A pair of flexible belts 84 extend around the rolls 76 to either side of each aligned pair of slicers 18 and 20 so that the lower run of each belt moves downstream above surface 14. Roll-engaging teeth 86 extend outwardly from belts 84. The ends of the teeth on the lower runs of belts 84 are located a distance above surface 14 slightly less than the normal height of the rolls in cluster 16 so that the teeth engage and slightly compress the rolls as they carry the rolls under the slicer.

As shown in FIGS. 1 and 3, the upper runs of the belts to either side of each pair of slicers are guided between the upstanding portions 48 of the spaced arms 44. The inner surfaces 49 of the portions 48 are rounded as shown in FIG. 3 to reduce wear on the outer edges of the belts. A belt spacer 88 extends downstream from block 30 and includes a portion 90 located between the lower or downstream moving runs of the belts. The arms 44 and spacer 88 cooperate to hold the belts together upstream of the slicer pair and apart downstream of the slicer pair so that the lower runs of the belts diverge as they pass the slicers. The divergent belts pull the tops of the buns apart and open the crease above the proof line.

As illustrated in FIG. 1, guides 22 are adjusted to orient two rows of hot dog bun clusters 16 for movement under the slicer 10. The clusters are fed downstream along surface 14 to the slicer by conventional means. The locking gates 72 of the middle and two edge vertical slicers are closed to hold the vertical slicers of these units above the clusters. The clusters are oriented so that the nominal proof lines between the two middle buns of each cluster are upstream of the slicer pairs located between the closed horizontal slicing units.

As the clusters are fed downstream toward the slicer, the lead ends of the clusters are brought under and are engaged by the teeth on the lower runs of belts 84. The teeth engage and lightly compress the rolls in the clusters, carrying them downstream toward the slicers. There is sufficient engagement between the belts and the tops of the buns that the divergence of the lower runs of the belts opens the crease at the proof line to facilitate reception of the vertical slicer head 60. The clusters are moved downstream so that the downstream ends of the buns pass the orienting portion 64 of the vertical slicer head and channel the portion into the opened crease above the proof line. The pendent holder 56 is free to swing laterally on shaft 50 and pivot or twist with respect to the shaft sufficiently to permit movement of the head into the irregular crease between the buns. The shaft 50 is sufficiently high above the buns so that despite pivoting of the holder as the orienting portion seeks and follows the crease between the rolls the blade is maintained essentially vertically.

As the clusters continue to move downstream past the vertical slicers, the blades 66 cut essentially vertical slits in the clusters between the middle two buns. The blades follow the irregular proof lines between the buns in response to movement of the orienting portion 64 along the corresponding crease above the proof line. Spring 68 prevents the holder 56 from being drawn downstream with the cluster. As the clusters move past the vertical slicers, they are brought into engagement with the horizontal slicers 20. The shafts of the horizontal slicers paired with the operating vertical slicers follow in the vertical slits 92 formed between the adjacent center rolls of each cluster so that the rotary blades carried thereby form slits 94 in each of the center rolls. The horizontal slicer shafts 32 are located on the nominal position of the proof line between the center two rolls. As the rolls move downstream, the upper portions of the rolls are resiliently compressed to either side of the shafts without injury to the rolls. The adjacent horizontal slicers form slits 96 in the outer rolls of the cluster. Following slicing, the belts carry the clusters to the downstream end of the slicer for pickup by conventional conveying means which carry the clusters away from the slicer.

If it is found that additional separation of the crease above the proof line is desirable in order to assure that the orienting portion of the vertical slicer accurately follows the crease, the inner edges of lower runs of the belts to either side of the slicers can be tipped down. This improves the engagement between the teeth and the bun so that the crease is opened wider.

As the clusters are moved past the vertical slicers, the pendent holder floats in the crease and is free to move laterally and pivot with lateral shifting of the crease. The blade follows the variations in the proof line and cuts a slit along the proof line. The result is a neat slit which automatically follows individual proof lines between adjacent rolls, despite irregularities in the proof line.

In conventional vertical roll slicers, the knife, whether driven or static, is held in a fixed position in alignment with the nominal or expected location of the proof line so that a straight slit is formed between adjacent buns and where the proof line varies, slivers of one bun are severed and remain attached to the other bun. These slivers render the finished product unsightly and reduce its saleability. Additionally, the slivers tend to break away from the buns at the weak proof line joint and roll up in the vertical slit. Sometimes the resultant dough balls become attached to the shaft of the horizontal slicer and tear the upstream clusters as they pass the slicer. These undesirable features of conventional fixed knife bun slicers are avoided by the present invention.

While we have illustrated and described a preferred embodiment of our invention, it is understood that this is capable of modification, and we therefore do not wish to be limited to the precise details set forth, but desire to avail ourselves of such changes and alterations as fall with the purview of the following claims.

What we claim as our invention is:

1. A bakery product slicer for forming slits in clusters of buns or the like as they are moved on a surface downstream past the bakery product slicer, the bakery product slicer comprising a support above the surface, a horizontal slicer having a vertical rotary shaft journaled in and held by the support, a rotary cutting blade on the lower end of the shaft and a drive for rotating the shaft and blade, and a vertical slicer on the support located upstream from the horizontal slicer and including a pendent holder suspended from the support, a head at the lower end of the holder, a connection between the upper end of the holder and the support permitting lateral movement of the head, the head including orienting means engagable with a crease in a bakery product cluster above a proof line so that as the cluster moves past the slicer lateral shifting of the crease moves the head laterally to follow the crease and a vertical slicing blade located downstream of the orienting means and further away from the support than the orienting means, the downstream end of the vertical slicing blade being positioned immediately upstream from the rotary cutting blade whereby as bakery product clusters move downstream past the bakery product slicer the vertical slicer cuts a vertical slit in the bakery product clusters following proof lines and the horizontal slicer cuts horizontal slits in the clusters to either side of the proof lines.

2. A bakery product slicer as in claim 1, including belt support means upstream and downstream of said slicers, belts on said support means to either side of said slicers, said belts including downstream moving runs adjacent said surface for engaging the tops of the bakery product clusters and moving the same past the slicers, said runs diverging from each other as they move downstream to open the creases above proof lines in the clusters.

3. A bakery product slicer as in claim 1, wherein said pendent holder includes a recess and said support includes a member extending through said recess so that the weight of the pendent holder and head holds the surface of the recess against the member and means on the member for limiting movement of the pendent holder with respect to the support.

4. A bakery product slicer as in claim 1, wherein said orienting means include smooth surfaces on the head facing the bakery product support surface, and the bottom of the head slopes downstream toward the support surface at a shallow angle.

5. A bakery product slicer as in claim 1, including a spring on the support engagable with the pendent holder to resist downstream movement of said head.

6. A bakery product slicer for forming a vertical slit extending along a proof line in clusters of buns or the like as they are moved downstream past the slicer on a surface, the slicer comprising a support above the surface, a pendent holder extending downwardly from the support toward the surface, a head at the lower end of the holder, a connection between the upper end of the holder and the support permitting lateral movement of the head, the head including orienting means at the upstream thereof engagable with a crease in the bakery product cluster above a proof line so that lateral shifting of the crease moves the head laterally and a vertical slicing blade at the downstream end of the head located further away from the support than the orienting means whereby as a bakery product cluster moves downstream past the slicer the vertical slicer cuts a vertical slit in the cluster below the crease and following the proof line.

7. A bakery product slicer as in claim 6, wherein said head includes a blunt nose at the upstream end and an orienting portion between the nose and blade having smooth surfaces engagable with the top of the cluster.

8. A bakery product slicer as in claim 7, including means engagable with the cluster to either side of the crease for opening the crease for reception of the orienting means.

9. A bakery product slicer as in claim 8, wherein said support includes a laterally extending shaft, said pendent holder includes a recess larger than said shaft and surrounding said shaft so that the weight of the pendent holder and head holds the recess against the shaft for lateral and pivotal movement of the holder with respect thereto.

* * * * *